United States Patent [19]

Ringwood

[11] 4,329,248

[45] May 11, 1982

[54] PROCESS FOR THE TREATMENT OF HIGH LEVEL NUCLEAR WASTES

[75] Inventor: Alfred E. Ringwood, Red Hill, Australia

[73] Assignee: The Australian National University, Australia

[21] Appl. No.: 124,953

[22] Filed: Feb. 26, 1980

[30] Foreign Application Priority Data

Mar. 1, 1979 [AU] Australia ..... PD7866
Jul. 26, 1979 [AU] Australia ..... PD9727

[51] Int. Cl.[3] ..... G21F 9/16

[52] U.S. Cl. ..... 252/628; 264/0.5; 252/629

[58] Field of Search ..... 252/301.1 W, 629; 264/0.5

[56] References Cited

U.S. PATENT DOCUMENTS 4,224,177 9/1980 Macedo et al. ..... 252/301.1 W
4,229,317 10/1980 Babad et al. ..... 252/301.1 W

OTHER PUBLICATIONS

McCarthy, G. J., "Crystalline and Coated High-Level Forms", Conf. High Level Rad. Solid Wasteforms, Denver, Colo., Dec. 1978.

Ringwood, A. E., "Safe Disposal of Nuclear Reactor Wastes: A New Strategy," Australian National University Press, Canberra, Australia, (Jul. 1978).

McCarthy, G. J., "High Level Waste Ceramics . . . ", *Nucl. Tech.,* vol. 32, (Jan. 1977), pp. 92–105.

*Primary Examiner*—Deborah L. Kyle
*Attorney, Agent, or Firm*—Bacon & Thomas

[57] ABSTRACT

A process for immobilizing high level waste (HLW) sludge containing aluminium and/or iron compounds which comprises the steps of:

(1) mixing the sludge with a mixture of oxides, the oxides in said mixture and the relative proportions thereof being selected so as to form a mixture when heated at temperatures between 800° and 1400° C. crystallizes to produce a mineral assemblage containing (i) crystals capable of providing lattice sites in which the fission product and actinide elements of said HLW sludge are securely bound, and (ii) crystals of at least one inert phase containing excess aluminium and/or iron, said crystals belonging to or possessing crystal structures closely related to crystals belonging to mineral classes which are resistant to leaching and alteration in appropriate geologic environments; and (2) heating and then cooling said mixture under reducing conditions so as to cause crystallization of the mixture to a mineral assemblage having the fission product and actinide elements of said HLW sludge incorporated as solid solutions within the crystals thereof, and the excess aluminium and/or iron crystallized in at least one inert phase.

A mineral assemblage containing immobilized HLW sludge containing aluminium and/or iron compounds incorporated within the crystals thereof is also disclosed.

36 Claims, No Drawings

PROCESS FOR THE TREATMENT OF HIGH LEVEL NUCLEAR WASTES

This invention relates to the treatment and disposal of high level radioactive wastes (HLW) containing high levels of iron, aluminium, nickel, manganese, sodium and uranium, such as those which have been produced by reprocessing of fuel from nuclear reactors used in the United States defence program. In particular, this invention relates to a process for immobilization of such wastes in a product which will safely retain dangerously radioactive isotopes from the waste for periods sufficient to ensure that they do not enter the biosphere prior to their decay.

In prior U.S. Patent Application Ser. No. 054,957 filed July 3, 1979, there are described methods for immobilizing high level wastes produced by typical non-military nuclear reactors. According to the disclosure of this prior specification, the high level wastes are incorporated in the form of dilute solid solutions in the crystal lattices of the minerals of a synthetic rock. A typical composition of this synthetic rock is given in Table 1.

TABLE 1

Typical synthetic rock composition according to U.S. Pat. Appl. Ser. No. 054,957.

| | wt. % |
|---|---|
| $TiO_2$ | 60.4 |
| $ZrO_2$ | 9.9 |
| $Al_2O_3$ | 11.0 |
| CaO | 13.9 |
| BaO | 4.2 |
| NiO | 0.6 |
| Mineralogy | |
| $BaAl_2Ti_6O_{16}$ | "hollandite" |
| $CaTiO_3$ | perovskite |
| $CaZrTi_2O_7$ | zirconolite |

This synthetic rock is composed mainly of the oxides of titanium, zirconium, calcium, aluminium and barium. When a mixture of oxides of this composition is heated (e.g. between 1000° C. and 1400° C.) it crystallizes to form a mixture of titanate minerals including $BaAl_2Ti_6O_{16}$ possessing the hollandite structure, $CaTiO_3$ perovskite, and $CaZrTi_2O_7$ zirconolite. Up to 30 percent of calcined high level wastes (a typical composition of which is given in Table 2 below) may be intimately mixed with the oxide mixture from which this synthetic rock is prepared. When the mixture of high level wastes plus synthetic rock oxides is heated at an appropriate temperature (e.g. 1000°-1400° C.) the high level waste components enter into solid solutions with the minerals of the synthetic rock. Once the wastes have been incorporated into the synthetic rock in this manner, they are extremely resistant to leaching and alteration when buried in appropriate geological environments. In such a manner, the wastes may be isolated from the biosphere for millions of years.

TABLE 2

Typical composition of calcined high level nuclear reactor wastes derived from reprocessing of fuel rods from civilian light-water reactors.

| | Mol percent |
|---|---|
| I. Fission Products | |
| Rare earths (REE) | 26.4 |
| Zr | 13.2 |
| Mo | 12.2 |

TABLE 2-continued

Typical composition of calcined high level nuclear reactor wastes derived from reprocessing of fuel rods from civilian light-water reactors.

| | Mol percent |
|---|---|
| Ru | 7.6 |
| Cs | 7.0 |
| Pd | 4.1 |
| Sr | 3.5 |
| Ba | 3.5 |
| Rb | 1.3 |
| II. Actinides | |
| U + Th | 1.4 |
| Am + Cm + Pu + Np | 0.2 |
| III. Processing Contaminants | |
| Fe | 6.4 |
| $PO_4$ | 3.2 |
| Na | 1.0 |
| IV. Others (mainly Tc, Rh, Te, I and processing contaminants including Ni, Cr) | 9.0 |

In the United States military reactor program, the high level wastes have been treated differently from wastes generated in civilian nuclear reactor programs. After the fuel rods have been dissolved in nitric acid, the solutions are made alkaline by the addition of large amounts of sodium hydroxide. In addition, large amounts of other elements, particularly iron, aluminium, manganese and nickel are introduced into the wastes. In the tank farms at Hanford and Savannah River, U.S.A., this procedure has caused most of the high level waste fission products and actinides (Table 2) to be precipitated to form a sludge of mixed oxides, hydroxides and other compounds at the bottom of the tanks. Mixed with these active components are large amounts of the hydroxides of aluminium, iron, manganese and nickel and other minor components including phosphorus, silicon, bismuth and mercury. In addition, variable amounts of sodium are adsorbed on, and/or combined with the sludge. It is proposed to treat these sludges by removing them from the tanks, adjusting the pH, washing, filtering and drying. After calcining, the composition of the sludges could be represented by a mixture of the fission products (minus Cs and Rb) and actinides of Table 2 with varying amounts of the oxides of aluminium, iron, manganese, nickel, sodium and silicon. The proportion of high level waste components (i.e. fission products and actinides, but excluding uranium) to the remaining "inert" oxides (of Al, Fe, Mn, Ni, Na, Si, and U) may vary widely from 0.5 to about 5 percent, but is commonly in the range 2 to 3 percent by weight. Likewise, the relative proportions of Al, Fe, Mn, Ni, Na, Si and U in the sludges from different tanks also vary between wide limits, except that (Fe+Al+Mn) are by far the major components and Fe is more abundant than Mn. Typical compositions of some dried and calcined sludges are given in Table 3. The sodium content of the sludge is largely dependent upon the nature of the washing process prior to calcining. If desired, sodium could be reduced below the levels given in Table 3 by a more efficient washing process.

TABLE 3

Estimated mean compositions of calcined sludges from Savannah River HLW tank farm (weight percent).

| | I Composite H area | II Composite F area | III Composite for entire area |
|---|---|---|---|
| $SiO_2$ | — | 2.2 | 0.9 |

TABLE 3-continued

Estimated mean compositions of calcined sludges from Savannah River HLW tank farm (weight percent).

| | I Composite H area | II Composite F area | III Composite for entire area |
|---|---|---|---|
| $UO_2$ | 3.5 | 3.7 | 3.4 |
| $Al_2O_3$ | 50.3 | 5.8 | 30.9 |
| $Fe_2O_3$ | 26.4 | 57.7 | 39.5 |
| MnO | 7.9 | 9.5 | 8.9 |
| NiO | 0.9 | 10.3 | 4.9 |
| CaO | 3.1 | 2.9 | 2.9 |
| $Na_2O$ | 5.0 | 5.0 | 5.6 |
| Fission products[1,2] plus actinides | ~3.0 | ~3.0 | ~3.0 |

Notes:
[1]Uranium has not been included with the remaining actinides. It is more appropriately classed with the 'inert' components because of its very long half-life and correspondingly low alpha-activity
Approximate relative proportions of individual fission products (excluding Cs, Rb) and actinides are given in Table 2.

The present invention provides a process for the treatment and immobilization of the mixture of high level waste containing large amounts of aluminium, iron, manganese, nickel and sodium compounds as components as described above. The essence of the invention is the incorporation of the radioactive waste component in synthetic titanate minerals as disclosed in the prior patent specification and the crystallization of the excess aluminium, iron, manganese, nickel and sodium oxides in highly refractory and leach-resistant minerals which are compatible thermodynamically with the waste-containing minerals of the previously disclosed synthetic rock.

According to one embodiment of the present invention, particularly applicable to sludges low in sodium, there is provided a process for immobilizing high level waste (HLW) sludge containing aluminium and/or iron compounds which comprises the steps of (1) mixing the sludge with a mixture of oxides, the oxides in said mixture and the relative proportions thereof being selected so as to form a mixture which when heated at temperatures between 800° and 1400° C. crystallizes to produce a mineral assemblage containing (i) crystals capable of providing lattice sites in which the fission product and actinide elements of said HLW sludge are securely bound, and (ii) crystals of at least one inert phase containing excess aluminium and/or iron, said crystals belonging to or possessing structures closely related to crystals belonging to mineral classes which are resistant to leaching and alteration in appropriate geologic environments; and (2) heating and then cooling said mixture under reducing conditions so as to cause crystallization of the mixture to a mineral assemblage having the fission product and actinide elements of said HLW sludge incorporated as solid solutions within the crystals thereof, and the excess aluminium and/or iron crystallized in at least one inert phase.

As the proportion of fission product and actinide elements in most HLW sludges containing aluminium and/or iron compounds is very small, only a minor proportion, for example from 20 to 40% by weight, of added oxides may be necessary to form the desired mineral assemblage.

This embodiment of the present invention, which is particularly applicable to sludges low in sodium, also provides a mineral assemblage containing immobilized HLW sludge containing aluminium and/or iron compounds, said assemblage comprising crystals belonging to mineral classes which are resistant to leaching and alteration in appropriate geologic environments having fission product and actinide elements of said HLW sludge incorporated as solid solutions within the crystals thereof, and the excess aluminium and/or iron crystallized in at least one inert phase.

In one aspect, this embodiment of the invention provides a process for the treatment and immobilization of sludges consisting mainly of mixtures of oxides of aluminium and iron with fission products and actinides, as described above, which comprises, in essence, the incorporation of the fission products and actinides (Tables 2 and 3) in synthetic titanate minerals (as disclosed in U.S. Patent Application Ser. No. 054,957) and the crystallization of the excess aluminium and iron oxides in highly refractory and leach resistant minerals which are thermodynamically compatible with the waste-containing minerals of the previously disclosed synthetic rock. According to this aspect of the invention, the excess Al and Fe oxides are immobilized in spinels such as $FeAl_2O_4$ (hercynite) and $Fe_2TiO_4$ (ulvospinel) and their solid solutions, ilmenite $FeTiO_3$ pseudobrookite solid solutions ($Al_2TiO_5$—$Fe_2TiO_5$), hollandite solid solutions ($BaAl_2Ti_6O_{16}$—$Ba(FeTi)Ti_6O_{16}$), a davidite-type mineral $BaAl_2Fe_8Ti_{13}O_{38}$ (approx.) and corrundum $Al_2O_3$. It has been demonstrated that all of these minerals, capable of immobilizing Al and Fe oxides, are also thermodynamically compatible with the zirconolite+"hollandite"+perovskite mineral assemblage employed to immobilize the actinide and fission product elements as dilute solid solutions. Where predominantly only the oxides of aluminium and iron are present in the sludge with fission products and actinides, the process may be carried out under a chemically reducing environment such that nearly all iron is maintained in the divalent state.

A second, and preferred embodiment of the present invention, however represents an improvement of the first embodiment described above, principally in two areas. Firstly, it can be applied to sludges containing relatively high amounts of sodium (e.g. 3–6 percent $Na_2O$), and secondly, it provides a more efficient means of immobilizing sludges very rich in iron such as the composition given in Column 2 of Table 3.

In general, in this embodiment of the invention, in order to immobilize sludges rich in sodium (Table 3) sufficient silica and, if necessary, alumina, are added so that on heating to temperatures in the range 800°–1400° C., a nepheline-type mineral ($NaAlSiO_4$) is formed. In many sludges, there is already sufficient $Al_2O_3$ present to combine with sodium in forming nepheline, so that further additions of this component are unnecessary.

Furthermore, in order to immobilize sludges which are rich in iron (columns 2 and 3, Table 3), the heat treatment is carried out under conditions which, although generally reducing, are not so strongly reducing as described with reference to the first aspect of the invention above. Preferably, the oxygen fugacity lies near the nickel-nickel oxide buffer. Under these conditions, when the sludges are heated, a substantial proportion of the iron occurs in the ferric state, whilst manganese and nickel are present as divalent species. Accordingly, most of the iron, aluminium, nickel, manganese, together with some of the added titanium crystallize to form a series of spinel-type solid solutions embracing the principal end members $$\overset{II}{FeAl_2O_4}\ (\text{hercynite})—\overset{II}{Fe_2}TiO_4\ (\text{ulvospinel})—\overset{II}{Mn}\overset{III}{Fe_2}O_4\ (\text{jacobsite})—\overset{II}{Ni}\overset{III}{Fe_2}O_4\ (\text{trevorite})—\overset{II}{Fe}\overset{III}{Fe_2}O_4\ (\text{magnetite}).$$

An advantage of carrying out the heat treatment under these conditions which are somewhat more oxidizing than described previously is that the amount of additives (e.g. $TiO_2$) necessary to immobilize ferrous iron, manganese and nickel in the sludge is substantially reduced.

According to this preferred embodiment of the present invention, there is provided a process for immobilizing high level waste (HLW) sludge containing high concentrations of Al, Fe, Mn, Ni and Na compounds which comprises the steps of (1) mixing the sludge with a mixture of oxides, the oxides in said mixture and the relative proportions thereof being selected so as to form a mixture which when heated at temperatures between 800° and 1400° C. crystallizes to produce a mineral assemblage containing (i) crystals capable of providing lattice sites in which the fission product and actinide elements of said HLW sludge are securely bound, and (ii) crystals of at least one inert phase containing excess aluminium, iron, manganese, nickel and sodium, said crystals belonging to or possessing crystal structures closely related to crystals belonging to mineral classes which are resistant to leaching and alteration in the appropriate geologic environments, and (2) heating and then cooling said mixture under controlled redox conditions so as to cause crystallization of the mixture to a mineral assemblage having the fission product and actinide elements of said HLW sludge incorporated as solid solutions within the crystals thereof, and the excess aluminium, iron, manganese, nickel and sodium crystallized in at least one inert phase.

Again, as the proportion of fission products and actinide elements in most HLW sludges containing Al, Fe, Mn, Ni and Na compounds is very small (e.g. ~3%—Table 3), only a minor proportion, for example from 20 to 40% by weight of added oxides may be necessary to form the desired mineral assemblage.

The present invention also provides in this preferred embodiment, a mineral assemblage containing immobilized HLW sludge containing Al, Fe, Mn, Ni and Na compounds, said assemblage comprising crystals belonging to mineral classes which are resistant to leaching and alteration in appropriate geologic environments and having fission product and actinide elements of said HLW sludge incorporated as solid solutions within the crystals thereof, and the excess Al, Fe, Mn, Ni and Na crystallized in at least one inert phase.

Preferably, the mixture of oxides which are added to the sludge in accordance with the present invention to produce the desired mineral assemblage is comprised of at least four members selected from the group $TiO_2$, $ZrO_2$, $SiO_2$, $Al_2O_3$, CaO, SrO, BaO, at least one of said members being selected from the subgroup consisting of $TiO_2$, $ZrO_2$ and $SiO_2$.

Still more preferably, the mixture of oxides which is added to the sludge in accordance with the present invention produce the desired mineral assemblage is comprised of at least three members selected from the group $TiO_2$, $ZrO_2$, $SiO_2$, $Al_2O_3$, CaO, at least two of said members being selected from the subgroup consisting of $TiO_2$, $ZrO_2$, and $SiO_2$.

It will be appreciated, however, that where NaO is not present in the sludge, for example, where it has been removed by pretreatment, the formation of nepholine is not required and accordingly the presence of $SiO_2$ in the mixtures described above is unnecessary.

As described above, the process of this aspect of the invention requires the heating stage to be carried out under controlled redox conditions so that manganese and nickel are maintained dominantly in the divalent state, whilst iron is maintained dominantly in the divalent or trivalent state, according to the particular composition of the sludge as described below. There are many methods well known to the art by which this can be achieved. According to one method, the required redox conditions can be achieved by heating in an atmosphere of controlled composition, for example an atmosphere consisting of an appropriate mixture of hydrogen, hydrocarbons, carbon monoxide, water vapour and carbon dioxide. According to another method, the sludge can be heated in the presence of metallic nickel, sufficient in amount to reduce all higher oxides of Mn to the MnO component and some of the ferric iron to the ferrous state. According to yet another method, the sludge can be heated in the presence of metallic iron, or of a mixture of metallic iron and metallic nickel sufficient in amount to reduce all higher oxides of Mn to the MnO component and most or all of the ferric iron to the ferrous state. These processes aimed at achieving preferred redox states may be performed as preliminary steps in the process; however they are preferably performed simultaneously with the heating stage of the process as the heating and cooling operations must be performed under controlled redox conditions in either case.

In one preferred embodiment of the invention, particularly applicable to sludges rich in $Al_2O_3$ (e.g. Column 1, Table 3), the oxides are selected so as to form a mixture which on heating and cooling in accordance with the invention, will crystallize to form a mineral assemblage containing crystals belonging or closely related to hercynite-rich spinel and at least one of the mineral classes selected from perovskite ($CaTiO_3$), zirconolite ($CaZrTi_2O_7$—$CaUTi_2O_7$ solid solution), and nepheline ($NaAlSiO_4$). It has been shown in U.S. Patent Application Ser. No. 054,957 that the first two of these minerals are capable of accepting most of the fission products and actinide elements (Table 2) into solid solution in their crystal lattices. It has since been found that zirconolite alone can accept most of these products and elements in the absence of perovskite and that nepheline can accept as much as four percent of caesium (Table 2) into solid solution in its structure. Nepheline is the mineral employed to immobilize most of the sodium in the sludge and if sodium is present in the sludge sufficient silica is added to form this mineral during heat treatment. If sodium is not present, however, formation of nepheline is unnecessary. In this particular embodiment of the invention, most of the excess $Al_2O_3$ in the sludge crystallizes to form the mineral hercynite $$(\overset{II}{FeAl_2}O_4).$$

In order to obtain this result, the heat treatment is carried out under conditions wherein nearly all iron, nickel and manganese are maintained in the divalent state.

Dependent upon the exact composition of the sludge and the exact proportion of added oxides, additional minerals containing Al, Fe, Mn, Ni and Ba can be formed, thereby immobilizing these elements. These minerals include corundum ($Al_2O_3$), pseudobrookite solid solutions ($Al_2TiO_5$—$FeTi_2O_5$), and hollandite solid solutions ($BaAl_2Ti_6O_{16}$—$Ba(FeTi)Ti_6O_{16}$). All of these minerals have been shown to be thermodynamically compatible with perovskite, zirconolite and nepheline. It will be appreciated by persons skilled in the art that the formulae of these minerals as given above have been simplified for convenience; for example part of the ferrous iron in the above minerals is replaced by $Ni^{2+}$ and $Mn^{2+}$, whilst some $Ti^{4+}$ occurs in the hercynite. Actual measured compositions of individual minerals occurring in a typical high-alumina sludge (Table 3, Column 1) when treated according to the present invention are given in Table 4 hereinafter.

In another preferred embodiment of the invention particularly applicable to sludges rich in iron (e.g. Column 2, Table 3), the oxides are selected so as to form a mixture which on heating and cooling in accordance with the invention, will crystallize to form a mineral assemblage containing crystals belonging or closely related to ferrite spinel and at least one of the mineral classes selected from perovskite ($CaTiO_3$), zirconolite ($CaZrTi_2O_7$—$CaUTi_2O_7$ solid solution), and nepheline ($NaAlSiO_4$). As demonstrated above, these minerals immobilize nearly all of the fission products and actinides. Again, if sodium is not present in the sludge formation of nepheline is unnecessary. Also, zirconolite alone can accept most of the fission products and actinide elements. In this particular embodiment of the invention, most of the excess iron in the sludge crystallizes to form a complex ferrite spinel solid solution composed principally of the end members $$\overset{III}{NiFe_2O_4}—\overset{III}{MnFe_2O_4}—\overset{II}{FeFe_2O_4}—\overset{III}{Fe_2}\overset{II}{TiO_4}—\overset{II}{FeAl_2O_4}.$$

In order to obtain this objective, the heat treatment is carried out under somewhat more oxidizing conditions than in the previous case, so that a large proportion of iron occurs in the ferric state, whilst manganese and nickel are maintained dominantly in the divalent state. Dependent upon the exact composition of the sludge, and the exact proportions of added oxides, additional minerals containing Al, Fe, Mn, Ni and Ba can be formed, thereby immobilizing these elements. These minerals include ilmenite ($FeTiO_3$), ulvospinel ($Fe_2Ti_3O_4$), ferropseudobrookite ($FeTi_2O_5$), hollandite $$Ba(\overset{III}{Al}, Fe, \overset{II}{Fe}, Ni, Ti)_2Ti_6O_{16}$$

and a mineral phase possessing the approximate composition $$Ba(\overset{III}{Fe}, \overset{II}{Al})_2Fe_8Ti_{13}—O_{38}.$$

All of these minerals have been shown to be thermodynamically compatible with perovskite, zirconolite and nepheline. It will be appreciated by persons skilled in the art that the formulae of these minerals as given above have been simplified for convenience; for example, part of the ferrous iron in the above minerals is replaced by $Ni^{2+}$ and $Mn^{2+}$, whilst some $Ti^{4+}$ occurs in the ferrite spinel solid solution. Actual measured compositions of individual minerals occurring in a typical high-iron sludge (Table 3, Column 2) when treated according to the present invention are given in Table 5 hereinafter. In this particular embodiment of the invention, most of the sodium present in the sludge is immobilized in the mineral nepheline, $NaAlSiO_4$. Accordingly, additional silica, and (if not already present) alumina, must be added to the sludge during or prior to heat treatment in such quantities that nepheline is preferentially formed. It has been demonstrated that nepheline is thermodynamically compatible with all of the other minerals and phases described above.

In other embodiments of this invention as applied to sludges containing intermediate amounts of excess aluminum and iron oxides (e.g. Table 3, Column 3), various mixtures of the above minerals may be formed when the sludge is heated with the added oxides as disclosed above. In general, the conditions for application of the invention to these intermediate compositions are themselves intermediate between those described separately for the cases of high-aluminium and high-iron sludges.

The selected mixture of oxides is preferably mixed directly with the sludge and without any preliminary drying or calcining of the sludge, as the use of a sludge assists in the mixing step. If desired or convenient, however, dried or calcined sludge may also be used in the purpose of the invention.

The broad objective of the present invention is to produce a synthetic rock, composed of titanate minerals chosen from the above groups, some of which (e.g. perovskite, zirconolite, hollandite) have the capacity to accept fission products and actinide elements from the sludge into solid solution into their crystal lattices and retain them tightly, whilst the excess $Al_2O_3$, $Fe_2O_3$, FeO, MnO,NiO and $Na_2O$ present in the sludge crystallizes to form additional inert phases, which are thermodynamically compatible with the minerals accepting the fission products and actinides. An important characteristic of the minerals chosen to make up the assemblage is that they belong to classes of natural minerals which are known to have been stable in a wide range of geological and geochemical environments for periods ranging from 20 million to 2000 million years. It is this characteristic, combined with existing knowledge in the fields of geochemistry, mineralogy and solid state chemistry which makes it possible to predict with a high degree of confidence, the capacity of the mineral assemblages of this invention to immobilize HLW elements for periods greatly exceeding the one million years interval necessary for decay of radioactive HLW elements to safe levels.

It is emphasized that although several of the minerals used in the assemblages of this invention have compositions similar to, or identical with natural minerals, the overall chemical compositions of these assemblages do not resemble those of any known kind of naturally occurring rock. It should also be noted that the crystal structure of zirconolite minerals is very closely related to that of pyrochlore, which possesses an identical stoichiometry. It is thus possible that some of the zirconolite-type phases (essentially $CaZrTi_2O_7$—$CaUTi_2O_7$ solid solutions) as described above and also in Tables 4 and 5 hereinafter, may actually have crystal structures more closely resembling those of pyrochlore than of zirconolite. For this reason, it is emphasized that the Ca-Zr-U-Ti phase used as a host for actinide elements in this invention may be either a zirconolite-type mineral or a mineral which is structurally and chemically very similar to natural zirconolite, including minerals with similar stoichiometries but with structures related to those of pyrochlore and defect fluorite.

The immobilization of fission products, actinide elements and excess Al, Fe, Mn, Ni and Na oxides in the sludge are accomplished as follows. The sludge is intimately mixed with selected additional components in the proportions necessary to form the desired mineral assemblage. A mixture of sludge and additional components is then heated under controlled redox conditions in order to achieve the desired oxidation states for Fe, Mn and Ni. The temperature of heating may be in the range 800°-1400° C., but is insufficient to cause extensive melting. This heat treatment, which may be carried out by sintering at atmospheric pressure in a controlled atmosphere, or which may be carried out under a confining pressure under controlled redox conditions, causes extensive recrystallization and sintering, mainly in the solid state, and yields a fine grained mineral assemblage in which the fission products and actinide elements of the HLW sludge are incorporated to form dilute solid solutions mainly in perovskite and zirconolite phases, and in which the excess Al, Fe, Mn, Ni and Na oxides are contained in at least one inert phase. The product, containing immobilized HLW elements, can then be safely buried in an appropriate geologic environment.

Six examples of the operation of the process according to the present invention are given below, together with certain modifications thereof. These examples relate to the immobilization of typical "high-Al" and "high-Fe" sludges possessing compositions as given in Table 3, Columns 1 and 2. Sludges possessing intermediate compositions, e.g. Table 3, Column 3 can be immobilized by treatments appropriately intermediate in nature between those described for Examples 1 and 2.

EXAMPLE 1 (a)

A "high-alumina" sludge characterized by a mixture of fission products and actinide elements with excess oxides of Al, Fe, Mn, Ni, U and Na, possessing the composition given in Table 3, Column 1, is mixed with about 30 percent of $TiO_2$, $ZrO_2$, CaO and $SiO_2$, in proportions chosen so that when the mixture is heated, the added oxides combine with the sludge components to form a mineral assemblage consisting principally of hercyniterich spinel+perovskite+zirconolite+nepheline. The heat treatment is carried out under controlled redox conditions such that most of the iron and nearly all manganese and nickel is maintained in the divalent state. The mixture is heated at a temperature of 1200° C. for several hours and simultaneously subjected to a confining pressure using the conventional technique known as hotpressing. Alternatively, the mixture may be formed and sintered at 1200° C. under the appropriate redox conditions without the application of pressure. The resulting product is found to be a fine grained, mechanically strong rock composed of the above minerals in which the HLW fission products and actinides are effectively immobilized. Actual compositions of the minerals in a rock produced in this manner are given in Table 4.

TABLE 4

Compositions of coexisting mineral phases in high-alumina sludge (Table 3, Column 1) treated as described in Example 1(a).

| | Nepheline | Perovskite | Zirconolite | Hercynite |
|---|---|---|---|---|
| $SiO_2$ | 41.5 | — | — | — |
| $TiO_2$ | 0.2 | 53.4 | 29.5 | 5.8 |
| $ZrO_2$ | — | 0.7 | 37.8 | 0.3 |
| $UO_2$ | — | 0.2 | 13.9 | — |
| $Al_2O_3$ | 35.9 | 2.4 | 1.1 | 48.2 |
| $Fe_2O_3$ | — | — | — | — |
| FeO | 0.8 | 2.7 | 4.1 | 37.4 |
| MnO | 0.2 | 1.7 | 0.9 | 7.2 |
| NiO | — | — | — | 0.4 |
| CaO | — | 39.6 | 12.3 | — |
| $Na_2O$ | 21.5 | 0.3 | 0.4 | — |
| Sum | 100.1 | 101.0 | 100.0 | 99.4 |

(b) In a modification of Example 1(a) above, the sludge is mixed with about 20–30 percent of the same oxides in proportions chosen to form a hercynite-rich spinel+zirconolite+nepheline mineral assemblage, and the mixture treated as above. A product physically similar to that of Example 1(a) is obtained with the fission products and actinides immobilized in the zirconolite phase.

(c) A "high-alumina" sludge as described in Example 1(a), is pretreated by washing to reduce the sodium content, mixed with about 20–30 percent of $TiO_2$, $ZrO_2$ and CaO in proportions chosen to form a hercynite-rich spinel+perovskite+zirconolite mineral assemblage and the mixture treated as above. A product physically similar to that of Example 1(a) is obtained.

(d) In a modification of Example 1(c) above, the sludge is mixed with about 20–30 percent of the same oxides in proportions chosen to form a hercynite-rich spinel+zirconolite mineral assemblage and the mixture treated as above. A product physically similar to that of Example 1(c) is obtained.

EXAMPLE 2(a)

A "high-iron" sludge, characterized by a mixture of fission products and actinide elements with excess oxides of Al, Fe, Mn, Ni, U and Na, possessing the composition given in Table 3, Column 2 is mixed with about 35 percent of $TiO_2$, $ZrO_2$, $Al_2O_3$, CaO and $SiO_2$ in proportions chosen so that when the mixture is heated, the added oxides combine with the sludge components to form a mineral assemblage consisting principally of ferrite spinel $(Mn, Ni, Fe)^{II}Fe_2^{III}O_4$+perovskite+zirconolite+nepheline. The heat treatment is carried out under controlled redox conditions such that most of the iron is in the trivalent state whilst most of the nickel and manganese are divalent. The mixture is heated at a temperature of 1200° C. for several hours and simultaneously subjected to a confining pressure using the conventional technique known as hot-pressing. Alternatively, the mixture may be formed and sintered at 1200° C. under the appropriate redox conditions without the application of pressure. The resulting product is found to be a fine grained, mechanically strong rock composed of the above minerals in which the HLW fission products and actinides are effectively immobilized. Actual compositions of the minerals in a rock produced in this manner are given in Table 5.

TABLE 5

Compositions of coexisting mineral phases in high-iron sludge (Table 3, Column 2) treated as described in Example 2(a).

| | Nepheline | Perovskite | Zirconolite | Ferrite Spinel |
|---|---|---|---|---|
| $SiO_2$ | 40.6 | — | — | — |
| $TiO_2$ | 0.5 | 56.3 | 35.1 | 7.9 |
| $ZrO_2$ | — | 0.6 | 25.2 | — |
| $UO_2$ | — | 0.2 | 15.5 | — |
| $Al_2O_3$ | 34.4 | 0.1 | 0.4 | 8.1 |
| $Fe_2O_3$ | 5.0 | 3.9 | 7.8 | 43.5 |
| FeO | — | — | — | 20.7 |
| MnO | — | 1.0 | 1.8 | 9.0 |
| NiO | — | 0.2 | — | 9.7 |
| CaO | — | 37.3 | 14.6 | — |
| $Na_2O$ | 20.1 | 0.3 | 0.2 | — |
| Sum | 100.6 | 100.0 | 100.6 | 99.4 |

(b) In a modification of Example 2(a) above, the sludge is mixed with about 20–35 percent of the same oxides in proportions chosen to form a ferrite spinel+zirconolite+nepheline mineral assemblage, and the mixture treated as above. A product physically similar to that of Example 2(a) is obtained with the fission products and actinides immobilized in the zirconolite phase.

(c) A "high-iron" sludge as described in Example 2(a) is pretreated by washing to reduce the sodium content, mixed with about 20–35 percent of $TiO_2$, $ZrO_2$ and CaO in proportions chosen to form a ferrite spinel+perovskite+zirconolite mineral assemblage, and the mixture treated as above. A product physically similar to that of Example 2(a) is obtained.

(d) In a modification of Example 2(c) above, the sludge is mixed with about 20–35 percent of the same oxides in proportions chosen to form a ferrite spinel+zirconolite mineral assemblage and the mixture treated as above. A product physically similar to that of Example 2(c) is obtained.

EXAMPLE 3

This example is similar to Example 1(a) except that (i) about 40 percent of mixed oxides ($TiO_2+ZrO_2+CaO+SiO_2$) are added to the sludge and (ii) a larger relative proportion of $TiO_2$ is added than in Example 1(a). Under these conditions, the synthetic rock is found to contain a pseudobrookite-type solid solution ($Al_2TiO_5$—$FeTi_2O_5$) in addition to the minerals mentioned in Example 1(a). In compositions richer in alumina than that given in Table 3, Column 1, a separate $Al_2O_3$ phase (corundum) may also occur.

EXAMPLE 4

The same procedure is followed as in Example 3, except that the added oxides contain some BaO. The mineral assemblage produced is similar to that in Example 3 except that a hollandite-type solid solution ($BaAl_2Ti_6O_{16}$—$Ba(Fe, Ni, Mn, Ti)_2Ti_6O_{16}$) is also produced in the synthetic rock.

EXAMPLE 5

This example is similar to Example 2(a) except that (i) about 40 percent of mixed oxides ($TiO_2+ZrO_2+CaO+SiO_2+Al_2O_3$) are added to the sludge and (ii) a larger relative proportion of $TiO_2$ is added than in Example 2(a). Under these conditions, the synthetic rock is found to contain ilmenite ($FeTiO_3$)±pseudo-brookite solid solution ($FeTi_2O_5$—$Al_2TiO_5$) in addition to the minerals mentioned in Example 2(a).

EXAMPLE 6

This example is similar to Example 5, except that the added oxides contain some BaO. The mineral assemblage produced is similar to that in Example 5 except that a complex davidite-type mineral $Ba(Al, Fe^{III})_2$—$Fe_8^{II}Ti_{13}O_{38}$ is also produced in the synthetic rock. Under some conditions, a hollandite-type phase $Ba(Al, Fe^{III}, Ni, Mn,$—$Fe^{II}, Ti)_2Ti_6O_{16}$ may also be produced.

The above examples lead to the production of strong, stable synthetic rocks in which fission products and actinide elements are immobilized in a mineral assemblage as was described in the prior patent specification. That specification, described the great stability of titanate-based synthetic rocks to leaching and alteration in diverse geological and geochemical environments. The modified synthetic rock compositions described herein, characterized by much higher abundances of Al, Fe, Mn, Ni, U and Na than were considered in the prior specification share the preceding characteristics.

The method of immobilizing HLW sludges described herein is greatly superior to the conventional technology of immobilizing the sludges by dissolving them in borosilicate glasses. Firstly, as shown in the prior patent specification, titanate-based synthetic rocks are enormously more stable toward leaching and decomposition than borosilicate glasses. Secondly, in most US defence HLW sludges, the proportion of fission products and actinide elements to "introduced" Al, Fe, Mn, Ni and Na oxides is very small, mostly between 0.5 and 5 percent. Thus, in most cases, it is only necessary to introduce from 20 to 40 percent of additional inert oxides (e.g. $TiO_2+ZrO_2+CaO+SiO_2$) in order to form the desired mineral assemblage. Of course, it would be possible to introduce more than 40 percent of additional inert oxide components if found especially desirable for specific purposes. However, in most cases, this would not be necessary.

Accordingly, it is possible to produce synthetic rocks containing 60–80 percent of sludge in the form of stable minerals. In contrast, it is not possible to incorporate readily more than 30 percent of sludge in borosilicate glasses. Moreover, because of the much higher density of synthetic rock (~4.5 g/cm$^3$) compared to borosilicate glass (~3.0 g/cm$^3$), a correspondingly higher weight of sludge can be incorporated in a given volume of rock as compared to glass. This results in considerable economic advantages when HLW sludges are incorporated in synthetic titanate rock.

It will be appreciated by persons skilled in the art that many modifications and variations may be made to the specific embodiments described herein without departing from the spirit and scope of the present invention as broadly described herein.

I claim:

1. A process for immobilizing high level nuclear waste containing a major proportion of aluminium and/or iron compounds which comprises the steps of (1) mixing the waste with a minor proportion of a mixture of oxides selected from the group consisting of $TiO_2$, ZrO, $SiO_2$, $Al_2O_3$, CaO, SrO and BaO, at least one of the selected oxides being from the group consisting of $TiO_2$, $ZrO_2$ and $SiO_2$, the oxides in said mixture and the relative proportions thereof being selected so as to form a mixture which when heated at temperatures between 800° and 1400° C. crystallizes to produce a mineral assemblage containing (i) crystals belonging to or possessing structures closely related to the titanate mineral classes capable of providing lattice sites in which the fission product and actinide elements of said waste are securely bound, and (ii) crystals thermodynamically compatible with said crystals (i) comprising at least one non-radioactive phase containing aluminium and/or iron, said crystals (i) and (ii) belonging to or possessing crystal structures closely related to crystals belonging to mineral classes which are resistant to leaching and alteration in geologic environments; and (2) heating at a temperature within said range and then cooling said mixture under reducing conditions so as to cause crystallization of the mixture to a mineral assemblage having the fission product and actinide elements of said waste incorporated as solid solutions within the crystals (i) thereof, and aluminium and/or iron crystallized in said at least one non-radioactive crystal phase (ii).

2. A process according to claim 1, wherein said waste is mixed with from about 20 to 40% by weight of said mixture of oxides.

3. A process according to claim 1, wherein said heating and cooling is carried out under reducing conditions such that said iron is maintained dominantly in a divalent state.

4. A process according to claim 1, wherein said mineral assemblage contains crystals belonging to or possessing structures closely related to the mineral classes selected from the group consisting of perovskite ($CaTiO_3$), zirconolite ($CaZrTi_2O_7$), and a hollandite-type mineral ($BaAl_2Ti_6O_{16}$).

5. A process according to claim 1, wherein said mineral assemblage comprises crystals belonging to or possessing structures closely related to at least one of the mineral classes selected from the group consisting of perovskite ($CaTiO_3$) and zirconolite ($CaZrTi_2O_7$-$CaUTi_2O_7$ solid solution).

6. A process according to claim 1, wherein said crystals (ii) include at least one phase selected from the group consisting of hercynite ($FeAl_2O_4$), ferrite ($(NiFeMn)Fe_2O_4$) and ulvospinel ($Fe_2TiO_4$) and their solid solutions, ilmenite ($FeTiO_3$), pseudobrookite solid solutions ($Al_2TiO_5$—$Fe_2TiO_5$), hollandite solid solutions ($BaAl_2Ti_6O_{16}$—$Ba(FeTi)Ti_6O_{26}$), a davidite-type mineral ($BaAl_2Fe_8Ti_{13}O_{38}$) and corundum ($Al_2O_3$).

7. A process according to claim 1, wherein said at least one non-radioactive phase includes hercynite-rich spinel or ferrite spinel.

8. A process according to claim 1, wherein said mixture of oxides comprises at least three members selected from the group consisting of $TiO_2$, $ZrO_2$, $Al_2O_3$, CaO, SrO and BaO, at least one of said members being selected from the subgroup consisting of $TiO_2$ and $ZrO_2$.

9. A process according to claim 8, wherein said mixture of oxides comprises at least two members selected from the group consisting of $TiO_2$, $ZrO_2$, $Al_2O_3$ and CaO, at least one of said members being selected from the subgroup consisting of $TiO_2$ and $ZrO_2$.

10. A process according to claim 1 wherein the waste contains $Al_2O_3$ in excess of $Fe_2O_3$ on a weight basis and the mixture of added oxides comprises $TiO_2$, $ZrO_2$ and CaO in proportions chosen so that the mineral assemblage comprises hercynite-rich spinel, perovskite and zirconolite.

11. A process according to claim 1 wherein the waste contains $Al_2O_3$ in excess of $Fe_2O_3$ on a weight basis and the mixture of added oxides comprises $TiO_2$, $ZrO_2$ and CaO in proportions chosen so that the mineral assemblage comprises hercynite-rich spinel and zirconolite.

12. A process according to claim 1 wherein the waste contains $Fe_2O_3$ in excess of $Al_2O_3$ on a weight basis and the mixture of added oxides comprises $TiO_2$, $ZrO_2$ and CaO in proportions chosen so that the mineral assemblage comprises ferrite spinel, perovskite and zirconolite.

13. A process according to claim 1 wherein the waste contains $Fe_2O_3$ in excess of $Al_2O_3$ on a weight basis and the mixture of added oxides comprises $TiO_2$, $ZrO_2$ and CaO in proportions chosen so that the mineral assemblage comprises ferrite spinel and zirconolite.

14. A mineral assemblage containing immobilized high level nuclear waste containing a major proportion of aluminium and/or iron compounds, said assemblage comprising crystals (i) belonging to mineral classes which are resistant to leaching and alteration in geologic environments having a fission product and actinide elments of said nuclear waste incorporated as solid solutions within the crystals thereof, said crystals (i) comprising crystals belonging to or possessing structures closely related to at least one of the mineral classes selected from the group consisting of perovskite ($CaTiO_3$) and zirconolite ($CaZrTi_2O_7$—$CaUTi_2O_7$ solid solution), and crystals (ii) thermodynamically compatible with said crystals (i) containing aluminum and/or iron crystallized in at least one non-radioactive phase.

15. A process for immobilizing high level nuclear waste containing high concentrations of Al, Fe, Mn, Ni and Na compounds which compounds constitute a major proportion of the waste which comprises the steps of (1) mixing the waste with a minor proportion of a mixture of oxides selected from the group consisting of $TiO_2$, ZrO, $SiO_2$, $Al_2O_3$, CaO, SrO and BaO, at least one of the selected oxides being from the group consisting of $TiO_2$, ZrO and $SiO_2$, the oxides in said mixture and the relative proportions thereof being selected so as to form a mixture which when heated at temperatures between 800° and 1400° C. crystallizes to produce a mineral assemblage containing (i) crystals belonging to or possessing structures closely related to the titanate mineral classes capable of providing lattice sites in which the fission product and actinide elements of said waste are securely bound, and (ii) crystals of at least one non-radioactive phase containing aluminium, iron, manganese, nickel and sodium, said crystals (ii) including crystals belonging to or possessing structure closely related to the nepheline ($NaAlSiO_4$) mineral class, said crystals (i) and (ii) belonging to or possessing crystal structures closely related to crystals belonging to mineral classes which are resistant to leaching and alteration in geologic environments, and (2) heating at a temperature within said range and then cooling said mixture so as to cause crystallization of the mixture to a mineral assemblage having the fission product and actinide elements of said waste incorporated as solid solutions within the crystals (i) thereof, and the aluminium, iron, manganese, nickel and sodium crystallized in the crystals (ii), said heating and cooling being conducted under redox conditions such that the manganese and nickel are dominantly present in the divalent state.

16. A process according to claim 15, wherein said waste is mixed with from 20 to 40% by weight of said mixture of oxides.

17. A process according to claim 15, wherein said heating and said cooling are carried out at reducing conditions such that said manganese and/or nickel are maintained dominantly in a divalent state and said iron is maintained dominantly in a divalent or trivalent state.

18. A process according to claim 17, wherein said reducing conditions are such that the oxygen fugacity lies near the nickel-nickel oxide buffer.

19. A process according to claim 15, wherein said crystals (i) comprise crystals belonging to or possessing structures closely related to the mineral classes selected from the group consisting of perovskite ($CaTiO_3$), zirconolite ($CaZrTi_2O_7$), and a hollandite-type mineral ($BaAl_2Ti_6O_{16}$).

20. A process according to claim 15, wherein said crystals (i) comprise crystals belonging to or possessing structures closely related to at least one of the mineral classes selected from the group consisting of perovskite ($CaTiO_3$) and zirconolite ($CaZrTi_2O_7$—$CaUTi_2O_7$ solid solution).

21. A process according to claim 15, wherein said crystals (ii) comprise at least one phase selected from the group consisting of hercynite-rich spinel ($Fe^{II}Al_2O_4$), corundum ($Al_2O_2$), pseudobrookite solid solutions ($Al_2TiO_5$—$FeTi_2O_5$), and hollandite solid solutions ($BaAl_2Ti_6O_{16}$—$Ba(FeTi)\ Ti_6O_{16}$).

22. A process according to claim 15, wherein said crystals (ii) comprise at least one phase selected from the group consisting of ferrite-spinel (composed principally of the end members Ni, $Fe_2^{II}O_4$—$MnFe_2^{III}O_4$—$Fe^{II}Fe_2^{III}O_4$—$Fe_2^{II}TiO_4$—$Fe^{II}Al_2O_4$), ilmenite ($FeTiO_3$), ulvospinel ($Fe_2Ti_3O_4$), ferropseudobrookite ($FeTi_2O_5$), hollandite ($Ba(Al,Fe^{III},Fe^{II},Ni,Ti)_2$—$Ti_6O_{16}$) and a davidite-type mineral ($Ba(Fe^{III},Al)_2$—$Fe_8^{II}Ti_{13}O_{38}$).

23. A process according to claim 15, wherein said crystals (ii) include phercynite-rich spinel or ferrite spinel.

24. A process according to claim 15, wherein said mixture of oxides comprises at least four members selected from the group consisting of $TiO_2$, $ZrO_2$, $SiO_2$, $Al_2O_3$, CaO, SrO, BaO, at least one of said members being selected from the subgroup consisting of $TiO_2$, $ZrO_2$ and $SiO_2$.

25. A process according to claim 24, wherein said mixture of oxides comprises at least three members selected from the group consisting of $TiO_2$, $ZrO_2$, $SiO_2$, $Al_2O_3$, CaO, at least two of said members being selected from the subgroup consisting of $TiO_2$, $ZrO_2$ and $SiO_2$.

26. A process according to claim 15 wherein the waste contains $Al_2O_3$ in excess of $Fe_2O_3$ on a weight basis and the mixture of added oxides comprises $TiO_2$, $ZrO_2$, CaO and $SiO_2$ in proportions chosen so that the mineral assemblage comprises hercynite-rich spinel, perovskite, zirconolite and nepheline.

27. A process according to claim 15 wherein the waste contains $Al_2O_3$ in excess of $Fe_2O_3$ on a weight basis and the mixture of added oxides comprises $TiO_2$, $ZrO_2$, CaO and $SiO_2$ in proportions chosen so that the mineral assemblage comprises hercynite-rich spinel, zirconolite and nepheline.

28. A process according to claim 15 wherein the waste contains $Fe_2O_3$ in excess of $Al_2O_3$ on a weight basis and the mixture of added oxides comprises $TiO_2$, $ZrO_2$, $Al_2O_3$, CaO and $SiO_2$ in proportions chosen so that the mineral assemblage comprises ferrite spinel $(Mn,Ni,Fe)^{II}Fe_2^{III}O_4$, perovskite, zirconolite and nepheline.

29. A process according to claim 15 wherein the waste contains $Fe_2O_3$ in excess of $Al_2O_3$ on a weight basis and the mixture of added oxides comprises $TiO_2$, $ZrO_2$, $Al_2O_3$, CaO and $SiO_2$ in proportions chosen so that the mineral assemblage comprises ferrite spinel, zirconolite and nepheline.

30. A process according to claim 15 wherein the waste contains $Al_2O_3$ in excess of $Fe_2O_3$ on a weight basis and the mixture of added oxides comprises $TiO_2$, $ZrO_2$, CaO and $SiO_2$ in proportions chosen so that the mineral assemblage comprises hercynite-rich spinel, perovskite, zirconolite, nepheline and a pseudobrookite-type solid solution ($Al_2TiO_5$-$FeTiO_5$).

31. A process according to claim 15 wherein the waste contains $Al_2O_3$ in excess of $Fe_2O_3$ on a weight basis and the mixture of added oxides comprises $TiO_2$, $ZrO_2$, CaO, BaO and $SiO_2$ in proportions chosen so that the mineral assemblage comprises hercynite-rich spinel, perovskite, zirconolite, nepheline and a hollandite type solid solution ($BaAl_2Ti_6O_{16}$—$Ba(Fe,Ni,Mn,Ti)_2$—$Ti_6O_{16}$).

32. A process according to claim 15 wherein the waste contains $Fe_2O_3$ in excess of the $Al_2O_3$ on a weight basis and the mixture of added oxides comprises $TiO_2$, $ZrO_2$, $Al_2O_3$, CaO and $SiO_2$ in proportions chosen so that the mineral assemblage comprises ferrite spinel $(Mn,Ni,Fe)^{II}Fe_2^{III}O_4$, perovskite, zirconolite, nepheline, ilmenite ($FeTiO_3$) and pseudo-brookite solid solution ($FeTi_2O_5$—$Al_2TiO_5$).

33. A process according to claim 32 wherein the mixture of added oxides also comprises BaO and the mineral assemblage also comprises a complex davidite-type mineral $Ba(Al,Fe^{III})_2$—$Fe_8^{II}Ti_{13}O_{38}$.

34. A process according to claims 1 or 15 wherein the selected mixture of oxides is mixed directly with a high level nuclear waste sludge without preliminary drying or calcining of the sludge.

35. A mineral assemblage containing immobilized high level nuclear waste containing Al, Fe, Mn, Ni and Na compounds, said compounds constituting a major proportion of said waste, said assemblage comprising crystals (i) belonging to mineral classes which are resistant to leaching and alteration in geologic environments and having fission product and actinide elements of said waste incorporated as solid solutions within the crystals thereof, said crystals (i) belonging to or possessing crystal structures closely related to at least one of the mineral classes selected from the group consisting of perovskite ($CaTiO_3$) and zirconolite ($CaZrTi_2O_7$—$CaUTi_2O_7$ solid solution), and crystals (ii) containing Al, Fe, Mn, Ni and Na, said crystals (ii) including crystals possessing crystal structures belonging to or closely related to the nepheline ($NaAlSiO_4$) mineral class.

36. A mineral assemblage according to claim 35, wherein said crystals (ii) include hercynite-rich spinel or ferrite spinel.

* * * * *